United States Patent [19]

Hasselmann

[11] Patent Number: 4,917,599

[45] Date of Patent: Apr. 17, 1990

[54] BURNER FOR COMBUSTIBLE GASES

[76] Inventor: Detley E. M. Hasselmann, 519 S. Nardo Ave., Solana Beach, Calif. 92075

[21] Appl. No.: 292,477

[22] Filed: Dec. 29, 1988

[51] Int. Cl.[4] ..... F23D 14/12

[52] U.S. Cl. ..... 431/328; 431/326

[58] Field of Search ..... 431/326, 328; 126/91 R, 126/92 AC, 92 R

[56] References Cited

U.S. PATENT DOCUMENTS

| | | | |
|---|---|---|---|
| 3,161,227 | 12/1964 | Goss et al. | 431/328 |
| 3,208,247 | 9/1965 | Weil et al. | 431/328 |
| 3,321,001 | 5/1967 | Vezzoli | 431/328 X |
| 3,434,791 | 3/1969 | Hayashi et al. | 431/328 |
| 4,435,155 | 3/1984 | Vigneau | 431/328 |
| 4,588,373 | 5/1986 | Tonon et al. | 431/328 |

*Primary Examiner*—Randall L. Green

*Attorney, Agent, or Firm*—Baker, Maxham, Jester & Meador

[57] ABSTRACT

A combustible gas burner having simple, effective safety features. The burner head is made of ceramic to provide insulation between the flame and the gas inlet, thereby preventing autoignition. The ceramic head is formed with a multiplicity of passages therethrough, which are sufficiently small to function as a flame arrester. This multiple passage structure also functions to reduce flame-out when a lean combustible gas mixture is subject to external dilution air. The ceramic burner head is secured to the gas inlet opening by means of a bonding agent which expands as it cures, thereby providing a positive mounting.

14 Claims, 1 Drawing Sheet

BURNER FOR COMBUSTIBLE GASES

FIELD OF THE INVENTION

This invention relates generally to the field of burners and more particularly concerns a burner head which functions as a flame arrester and insulates incoming combustible gas from the hot flame, thereby preventing autoignition.

BACKGROUND OF THE INVENTION

Many structures have been devised to prevent combustible gases from preigniting before reaching the nozzle of the head of a burner. Some of these devices have been more successful than others. The more effective such devices have been relatively complex and expensive but have generally achieved the desired result.

Often the incoming flammable gas to a burner head is a relatively lean mixture. Under most circumstances external air further dilutes the gas being emitted from the burner head, that is, the gas in the pre-combustion zone. Sometimes this dilution reduces the concentration of combustible elements of the gas below that which can maintain a flame, and the burner will fail to remain lighted. Various structures have been proposed to solve this problem.

Another requirement for burners, at least under some circumstances, is that it include, or function as, a flame arrester. Flame arrestors are also well known and generally effective, but frequently they are also relatively complex and costly.

What has not been generally available has been a very simple, inexpensive and effective burner head which not only prevents autoignition, but also acts as a flame arrester and prevents the adverse effects of dilution air.

SUMMARY OF THE INVENTION

Broadly speaking, the invention comprises a ceramic honeycomb structure burner head mounted at the end of the combustible gas outlet. The honeycomb structure is formed in such a manner as to prevent flames from passing through the holes in the honeycomb, thereby functioning as a flame arrester. The ceramic structure insulates the flame from the gas outlet, thereby preventing autoignition. A significant beneficial purpose of this burner head is to concentrate the flame and reduce the effects of external dilution air.

Another unique feature of the invention is a structure which enables positive connection of the ceramic burner head to the normally metal housing of the gas flow pipe. The bonding agent which secures the ceramic to the inside opening of the combustible gas inlet functions in such a way that it expands upon drying or curing. This characteristic not only enables positive interconnection between the ceramic and the metal, but also places the ceramic in a state of compression which it can easily withstand, so that there are no adverse stresses on the comparatively fragile ceramic burner head.

BRIEF DESCRIPTION OF THE DRAWING

The objects, advantages and features of this invention will be more readily perceived from the following detailed description when read in conjunction with the accompanying drawing, in which.

DESCRIPTION OF THE PREFERRED EMBODIMENTS

Figure 2:
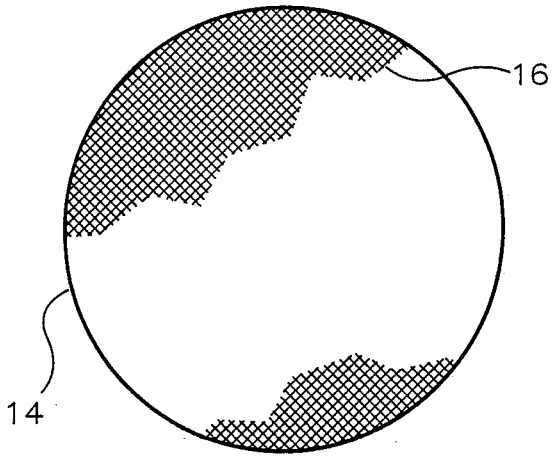
FIG. 2 is a top view of the burner head of FIG. 1.

With reference now to the drawing, there is shown gas inlet pipe 11 having an expanded diameter housing 12. Mounted in the open end 13 of the housing is ceramic burner head 14. The burner head is secured within opening 13 by means of bonding agent 15.

Figure 1:
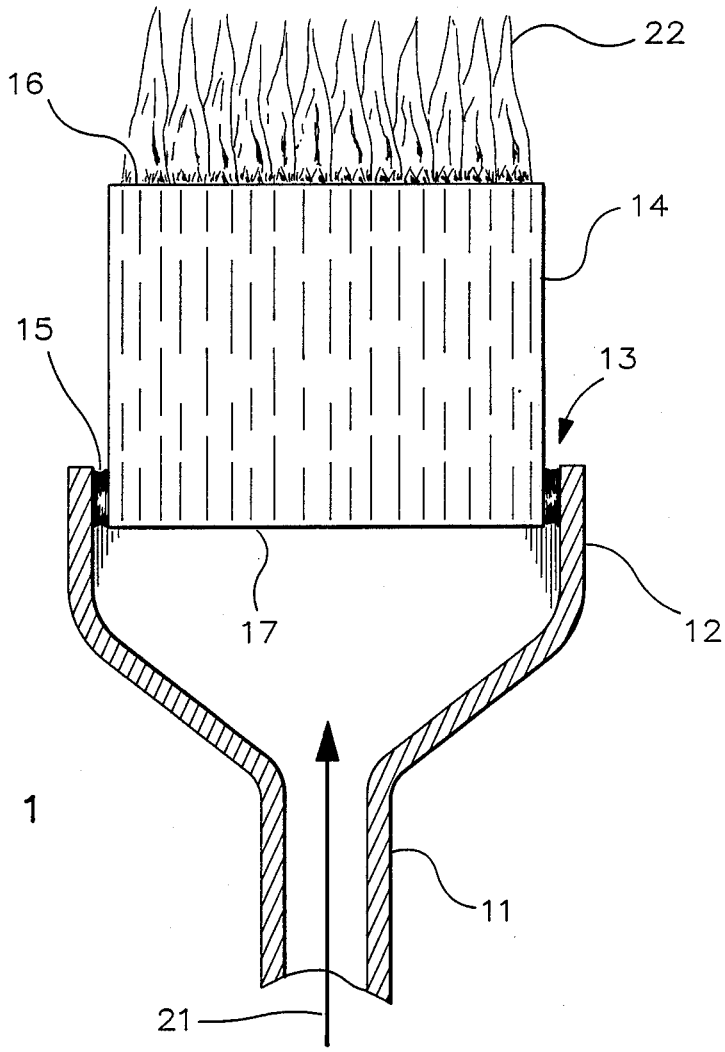
FIG. 1 is a side sectional view of the burner of the this invention.

The gas inlet tube is normally metal, as is housing 12. Previous attempts to secure a ceramic burner head in an opening such as opening 13 of the housing have tended to cause cracks in the ceramic due to the fact that most adhesives or bonding agents contract upon curing. As can be seen from FIG. 1, if bonding agent 15 tended to contract, a significant tension could be placed upon the burner head and there would, of necessity, be areas of the circumference of the burner head where the bonding agent would either separate from the inside surface of the housing or from the ceramic head or it would separate a piece of the ceramic from the head itself.

The bonding agent employed in the invention has the advantageous characteristic of expanding as it cures, thereby putting ceramic burner head 14 into a state of compression within opening 13 in housing 12. An example of a product which has this characteristic is sold by X-Pando Products Company under the trademark X-Pando. The amount of compression exerted by such a bonding agent employed with the structure shown is easily withstood by ceramic burner head 14.

As can be seen in FIG. 2, the ceramic burner head has a honeycomb structure with a multiplicity of holes passing from top surface 16 to bottom surface 17, thereby providing passages for the combustible gas to move in the direction of arrow 21 through the gas inlet pipe and out through burner head 14. Each opening of the honeycomb acts as a small diameter channel through which the combustible vapors flow. The structure of burner head 14 has preferably 200 to 400 of the small passages per square inch of ceramic head cross section. The passages may be of any cross sectional shape. They are shown square.

Another significant advantage of the multiple passage honeycomb structure of the burner head is that it also acts as a flame concentrator. End 16 of the burner head functions as a multiplicity of mini burner heads clustered together. The outside or circumferential jets are subject to external dilution air, but they protect and physically insulate the majority of the jets located within the ring of outer jets. Therefore these internal jets are not affected by dilution air and a combustible but lean mixture can maintain a flame. This structure of burner head 14 does not lead to a lean mixture becoming too lean in the pre-combustion zone to allow continued burning.

One element of uniqueness of the burner of this invention is that the ceramic insulates the incoming gas from the hot flame designated by reference numeral 22. Without the ceramic head, it was very possible for the housing around the combustible gas outlet to become quite hot. If the gas mixture through the gas inlet pipe is in the flammable range, the possibility previously existed that the vapors in the inlet pipe could be ignited if the burner head itself became sufficiently hot. This is known as autoignition, and has indeed occurred in many instances. Autoignition cannot occur with the burner of this invention because ceramic head 14 remains cool and insulates housing 12 so it cannot become overheated.

If the velocity of the combustible gases flowing through inlet pipe 11 is lower than the velocity of the frame front, it is possible that, without head 14, the flame front could travel upstream. Most flammable vapors will not allow a flame to pass through a hole less than 1/16 (0.0625) inch (1.59 mm). By having the honeycomb passages with a diameter of less than 0.0625 inch, the flame front will not propagate upstream and ignite the vapors in the inlet pipe. This way, burner head 14 acts as a flame arrester. As stated above, 200 to 400 passages per square inch is well below the theoretical threshold size of about 16 to the inch (256 per square inch), thereby ensuring that there is no real possibility of flame propagation into the gas delivery housing and pipe.

In view of the above description, it is likely that modifications and improvements will occur to those skilled in the art which are within the scope of the appended claims.

What is claimed is:

1. A burner for combustible gases, said burner comprising:

means constituting a gas inlet, said means being adapted to be coupled to a source of combustible gas;

a hollow metal housing connected to said gas inlet means and having an outer opening;

a thin walled ceramic burner head means having an inner end and an outer end and a multiplicity of passages therethrough extending directly and uninterruptedly from said inner end to said outer end, said burner head means being mounted in said metal housing opening and projecting outwardly therefrom, the combustible gases passing through said burner head means and being ignited at said outer end thereof, each said passage functioning as a separate burner at its outer end, each said passage being of such small diameter as to prevent flame propagation therethrough, and a bonding agent securing said ceramic burner head means to said metal housing and having the characteristic of expanding as it cures, thereby putting said burner head in compression when the bonding agent is fully dry.

2. The burner recited in claim 1, wherein said burner head means is so shaped and configured to have a multiplicity of mini burner heads for emission of jets of combustible gases therefrom.

3. The burner recited in claim 2, wherein the peripheral ones of said mini burner heads protect and insulate from external dilution air said mini burner heads positioned within said outer end of said burner head means and surrounded by said peripheral ones of said mini burner heads.

4. The burner recited in claim 1, wherein said ceramic burner head means has a honeycomb structure with a multiplicity of passages therethrough being oriented so that the combustible gas passes therethrough from said inner end to said outer end.

5. The burner recited in claim 4, wherein said passages are no larger than 0.0625 inch (1.59 mm) across.

6. The burner recited in claim 5, wherein there are 200 to 400 passages per square inch of cross section of said ceramic head.

7. The burner recited in claim 6, wherein said multiplicity of passages terminate in a like multiplicity of mini burner heads at said outer end of said burner head means.

8. The burner recited in claim 7, wherein the peripheral ones of said mini burner heads protect and insulate from external dilution air said mini burner heads positioned within said outer end of said burner head means and surrounded by said peripheral ones of said mini burner heads.

9. The burner recited in claim 5, wherein said multiplicity of passages terminate in a like multiplicity of mini burner heads at said outer end of said burner head means.

10. The burner recited in claim 9, wherein the peripheral ones of said mini burner heads protect and insulate from external dilution air said mini burner heads positioned within said outer end of said burner head means and surrounded by said peripheral ones of said mini burner heads.

11. The burner recited in claim 4, wherein said multiplicity of passages terminate in a like multiplicity of mini burner heads at said outer end of said burner head means.

12. The burner recited in claim 11, wherein the peripheral ones of said mini burner heads protect and insulate from external dilution air said mini burner heads positioned within said outer end of said burner head means and surrounded by said peripheral ones of said mini burner heads.

13. A burner for combustible gases, said burner comprising:

means constituting a gas inlet, said means being adapted to be coupled to a source of combustible gas;

a hollow metal housing connected to said gas inlet means and having an outer opening;

a thin walled ceramic burner head means having an inner end and an outer end, said burner head means being mounted in said metal housing opening and projecting outwardly therefrom, the combustible gases passing through said burner head means and being ignited at said outer end thereof; and a bonding agent securing said ceramic burner head means to said metal housing and having the characteristic of expanding as it cures, thereby putting said burner head in compression when the bonding agent is fully dry;

said burner head means having a honeycomb structure with a multiplicity of passages directly and uninterruptedly therethrough from said inner end and forming a multiplicity of mini burner heads on said outer end, each said passage being of such small diameter as to prevent flame propagation therethrough.

14. A burner for combustible gases, said burner comprising:

means constituting a gas inlet, said means being adapted to be coupled to a source of combustible gas;

a hollow metal housing connected to said gas inlet means and having an outer opening;

a thin walled ceramic burner head means having an inner end and an outer end, said burner head means being mounted in said metal housing opening and projecting outwardly therefrom, said burner head means being so shaped and configured to have a multiplicity of passages directly and uninterruptedly therethrough forming a like multiplicity of mini burner heads for emission of individual jets of combustible gases therefrom at said outer end, the combustible gases passing through said burner head means and being ignited at said outer end thereof, each said passage being of such small diameter as to prevent flame propagation therethrough; and a bonding agent securing said ceramic burner head means to said metal housing and having the characteristic of expanding as it cures, thereby putting said burner head in compression when the bonding agent is fully dry.

* * * * *